United States Patent [19]

Pinkham et al.

[11] 4,062,584

[45] Dec. 13, 1977

[54] COMBINATION SEAT AND CARRYING CASE

[76] Inventors: Warren Pinkham; Alice Pinkham, both of 8 Pond St., Essex, Mass.

[21] Appl. No.: 721,432

[22] Filed: Sept. 8, 1976

[51] Int. Cl.[2] ..... A47C 7/62

[52] U.S. Cl. ..... 297/193; 190/8; 224/46 R

[58] Field of Search ..... 224/46 R, 47, 45 R; 190/2, 8, 1, 42, 48; 5/2 R, 344; 297/188, 192, 193, 118, 217

[56] References Cited

U.S. PATENT DOCUMENTS

| | | | |
|---|---|---|---|
| 2,544,896 | 3/1951 | Nidetch et al. | 297/193 |
| 2,915,154 | 12/1959 | Holder | 190/8 |
| 3,092,224 | 6/1963 | O'Neil | 297/118 |
| 3,422,938 | 1/1969 | Worchester | 190/8 |
| 3,532,378 | 10/1970 | Dalia | 297/118 |
| 3,763,972 | 10/1973 | Kalzmar | 297/118 |

FOREIGN PATENT DOCUMENTS

| | | | |
|---|---|---|---|
| 554,074 | 7/1957 | Canada | 297/118 |
| 776,934 | 6/1957 | United Kingdom | 190/8 |

*Primary Examiner*—Albert J. Makay
*Assistant Examiner*—Kenneth Noland

[57] ABSTRACT

A carrying case, having a shaped seat area and armrests therein contains interior space reachable under the hinged seat area for carrying articles such as skates, food and drink.

1 Claim, 2 Drawing Figures

COMBINATION SEAT AND CARRYING CASE

BACKGROUND OF THE INVENTION

Many activities, especially those performed outdoors, require the transportation of materials to the site of the activity. When the activity is one which takes a long time, such as ball games, skating and picnicking, it is often desireable to have a clean, warm comfortable place to sit.

U.S. Pat. Nos. 3,092,224, 3,120,404, and 3,532,378 show carrying cases unfolding into seats having folding back rests. Neither these patents nor others in the prior art disclose a combination seat and carrying case with arm rests adjacent to the seat

SUMMARY OF THE INVENTION

The instant invention teaches a carrying case, preferably molded of plastic material, in which a seat-shaped indented region is useful for sitting upon.

The seat shaped indentation is hinged and, when lifted, permits access to the interior of the carrying case. A handle or strap is attached to enable carrying. The bottom of the carrying case is flattened to provide a stable base for resting upon the underlying surface.

DETAILED DESCRIPTION OF THE DRAWINGS

Figure 1:
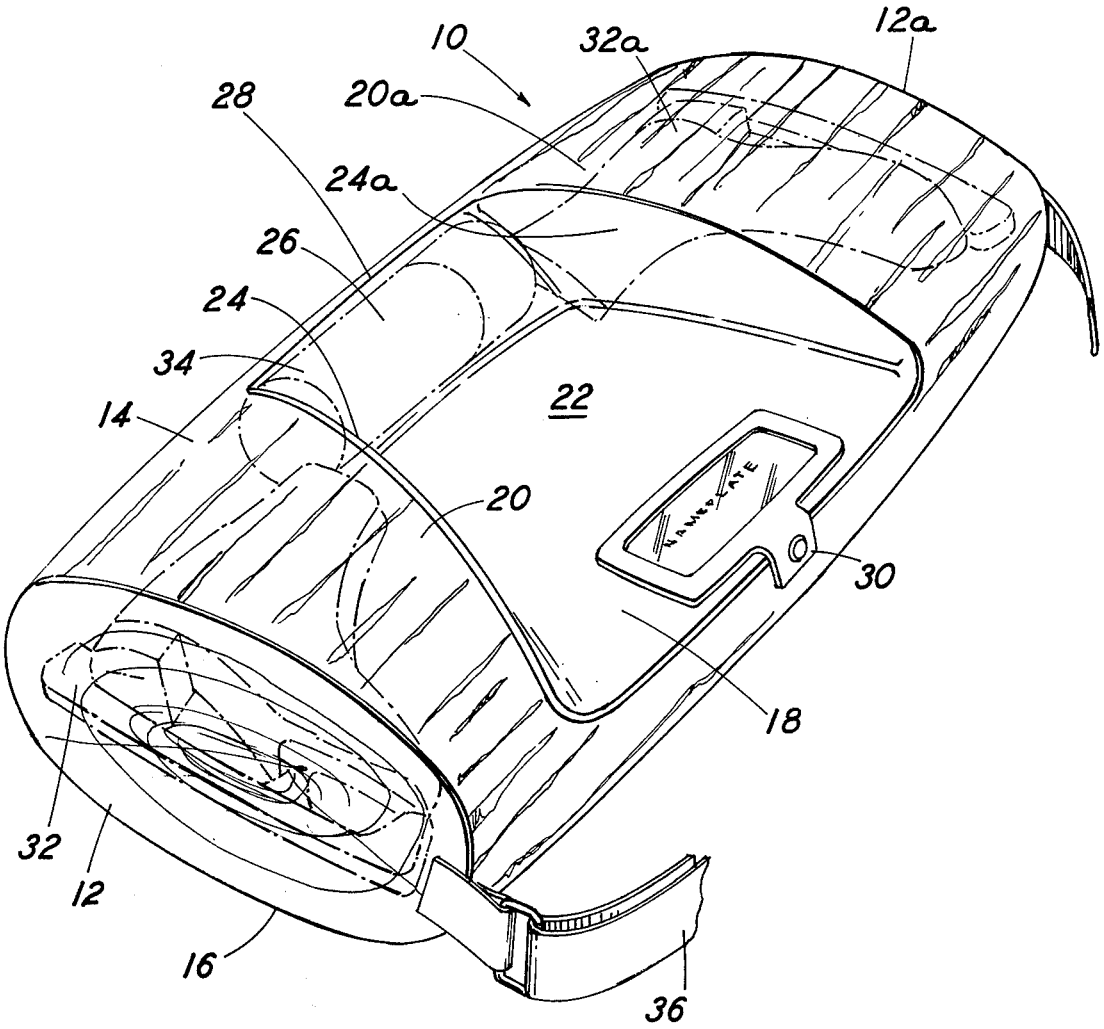
FIG. 1 shows a ghost perspective view of the carrying case.

Referring to FIG. 1, the carrying case, shown generally at 10, has two ends 12, 12*a* and a curved body 14. The bottom 16 of the curved body 14 is flattened to provide a stable base for resting upon the underlying surface. The body 14 and ends 12, 12*a* can be made of any suitable material but is preferably made of a thermoplastic material such as polyvinyl chloride or polyethylene. A decorate pattern may be molded into the surface of the carrying case and the material may contain any suitable color. For example, for outdoor use, the carrying case may be colored brown and a decorative pattern simulating tree barks may be molded into its surface.

A seat-shaped depression 18 is located in the center of the body 14. the regions of the body 14 adjacent the seat-shaped depression 18 are effective to provide arm rests 20, 20*a* to the user. The seat-shaped depression 18 has a seat part 22, two side walls 24, 24*a* joining the sides of the seat part 22 to the arm rests 20, 20*a* and a back part 26 joining the rear of the seat part 22 to the body 14. The seat-shaped depression 18 with all its parts 22, 24, 24*a*, 26 is hinged at the top of the back part 26 along the line 28. A latch 30, preferably of the molded button and hole type secures the front of seat part 22 to the lower part of the body 14.

The ghost view shows the placement of articles within the carrying case 10. For example, ice skates 32, 32*a* roller skates or other implements may conveniently be stowed in the ends. A compartment adapted to storage of a cylindrical vacuum bottle 34 may be formed behind the back part 26. Other articles may be stored in the remainder of the interior.

A handle or shoulder strap 36 is connected to the ends 12, 12*a* or the body to enable carrying.

Figure 2:
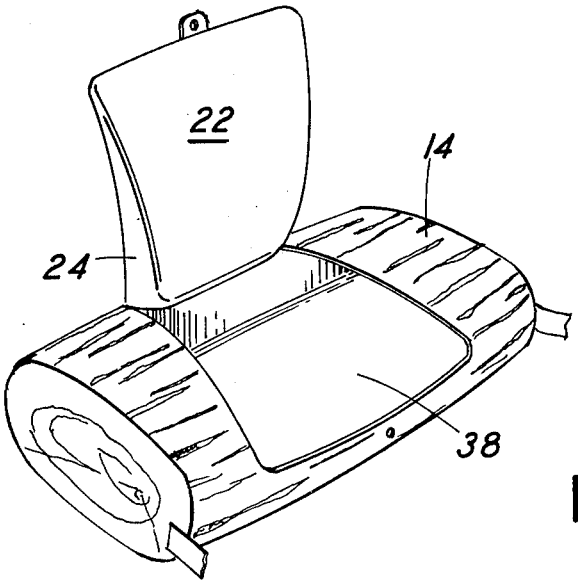
FIG. 2 shows a perspective view of the carrying case with the seat hinged open for access to the interior.

FIG. 2 shows the manner in which the seat-shaped depression 18 is hinged upward as a unit to reveal the access opening 38 to the interior.

It will be understood that the claims are intended to cover all changes and modifications of the preferred embodiments of the invention, herein chosen for the purpose of illustration which do not constitute departures from the spirit and scope of the invention.

What is claimed is:

1. A carrying case and seat comprising a. a hollow rigid molded plastic body;

b. said body being elongated and having a generally oval cross section normal to the elongated dimension;

c. one side of the oval cross section being the bottom and said bottom being flattened to conform to a generally flat surface;

d. an opening centrally located in the top of said body;

e. a seat shaped cover having open and closed positions hingedly connected to said body and operative to fit in and to close said opening when in its closed position;

f. said seat shaped cover giving access to the interior of said case when in its open position;

g. the seat shaped cover having a seat part which is recessed into said body when in its closed position and useable as a seat without adjustment;

h. first and second portions of the top of said body outboard of said opening laterally adjacent to said seat-shaped cover being effective as arm rests;

i. the hollow interior of said body being adapted to the storage of articles;

j. a latch for holding the seat-shaped cover in the closed position; and k. a carrying strap for carrying said carrying case.

* * * * *